US005206053A

United States Patent [19]

Calcaterra et al.

[11] Patent Number: 5,206,053

[45] Date of Patent: Apr. 27, 1993

[54] METHOD OF COATING FOR ENHANCEMENT OF BULK AND HAND IN CARPETS

[75] Inventors: Lidia T. Calcaterra; Mathias P. Koljack, both of Arlington Heights, Ill.

[73] Assignee: Allied-Signal Inc., Morris Township, Morris Country, N.J.

[21] Appl. No.: 784,838

[22] Filed: Oct. 30, 1991

[51] Int. Cl.[5] ..... B05D 3/02

[52] U.S. Cl. ..... 427/373; 427/389.9

[58] Field of Search ..... 427/389.9, 373; 428/96

[56] References Cited

U.S. PATENT DOCUMENTS

| | | | |
|---|---|---|---|
| 3,720,637 | 3/1973 | Bacskai | 524/549 |
| 4,070,152 | 1/1978 | Pentz | 8/115.6 |
| 5,118,551 | 6/1992 | Calcaterra et al. | 428/96 |

*Primary Examiner*—Evan Lawrence

*Attorney, Agent, or Firm*—Harold N. Wells; Mary Jo Boldingh; Gerhard H,. Fuchs

[57] ABSTRACT

An enhancement of the bulk and hand of carpeting and carpet fiber is made by treating with a terpolymer, particularly the terpolymer of (a) phenyl vinyl ether, (b) 2-(4-hydroxymethyl-phenoxy)ethyl vinyl ether, and (c) maleic anhydride.

8 Claims, No Drawings

METHOD OF COATING FOR ENHANCEMENT OF BULK AND HAND IN CARPETS

BACKGROUND OF THE INVENTION

This invention relates to the physical characteristics of carpet, in particular to the qualitative sense of substance in the pile. It will be understood that quality in carpeting will relate in part to the amount of fiber contained in the pile, that is, a carpet containing more fiber for each square yard (or square meter) is both more costly and longer lasting. If one could enhance the impression that a carpet was dense and contained a greater amount of fiber, then the carpet would have greater appeal to the customer, while reducing the cost to the manufacturer. The present inventors have discovered that application of certain polymers (previously disclosed in co-pending U.S. Pat. No, 07/649,501) to carpet fibers is capable of enhancing the sense of bulk and hand relative to other related materials.

SUMMARY OF THE INVENTION

In one aspect, the invention is a process for the enhancement of the sense of bulk and hand in carpeting by application of a terpolymer of the monomers (a) phenyl vinyl ether, (b) 2-(4-hydroxymethyl-phenoxy)ethyl vinyl ether, and (c) maleic anhydride.

In another aspect, the terpolymer may be replaced by a mixture of two copolymers prepared from the previously described monomers, that is, a copolymer of (a) and (c) and a copolymer of (b) and (c). Preferably the mixture is about 30–20 wt.% of the copolymer of (b) and (c) and 70–80 wt.% of the copolymer of (a) and (c).

DETAILED DESCRIPTION OF THE INVENTION

Terpolymer

The terpolymer of the invention may be described as the product of the reaction of three monomers, (a) -phenyl vinyl ether i.e.

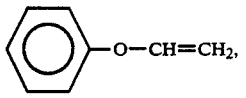

(b) 2-(4-hydroxymethyl-phenyl)ethyl vinyl ether, i.e.

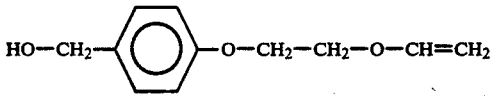

(c) maleic anhydride, i.e.

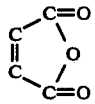

A protecting group, preferably —$OSi(CH_3)_3$, or alternatively —$OCOCH_3$, is substituted for the —OH group of monomer (b) and then after the terpolymer has been formed, it is hydrolyzed to convert the —$OSi(CH_3)_3$ group back to a —OH group. The addition of a protective group avoids the reaction between the —OH group of monomer (b) and the maleic anhydride. The terpolymer will include about 35 to 40 mol.% (a), 15 to 10 mol.% (b), and 50 mol.% (c). The synthesis of the terpolymer is given below in an example disclosing the preparation of the preferred terpolymer, but generally the procedure may be carried out by reacting the monomers in a solvent, such as 1,2-dichloroethane at a temperature of about 40° to 100° C., using as a catalyst, a radical initiator e.g. VAZO® followed by hydrolysis.

Although not a terpolymer, its functional equivalent is a mixture of two copolymers which are the reaction product of (a) and (c) and the reaction product of the (b) and (c) having the proportions 30–20 wt.% (b) +(c) and 70–80 wt.% (a) +(c).

APPLICATION OF THE TERPOLYMER

Once the terpolymer has been prepared it may be applied by several methods, including soaking the carpeting or the carpet fiber in an aqueous solution of the terpolymer and then drying the carpet or fiber. Other techniques which may be used include spraying an emulsion of the polymer followed by drying or applying a foam formulation of the copolymer followed by drying.

EXAMPLE 1

Synthesis of Phenyl Vinyl Ether Monomer (a)

Phenyl vinyl ether was prepared according to the method of Mizuno et al. (Synthesis, 1979, 688) by dehydrohalogenation of phenyl-2-bromo ethyl ether with aqueous sodium hydroxide utilizing tetra-n-butylammonium hydrogen sulfate as the phase transfer catalyst. The reaction is exothermic and was completed within 1.5 hours at ambient temperature. The monomer was purified by fractional distillation.

Preparation of 2-(4-Hydroxymethyl-phenoxy)Ethyl Vinyl Ether (b)

In a 500 mL three-neck round-bottom flask equipped with an overhead stirrer and a reflux condenser were placed 21.7 g of 4-hydroxybenzyl alcohol, and 65 mL of dimethyl sulfoxide. To this solution was slowly added 6.99 g of NaOH, while keeping the temperature below 45° C. After the solution was completed, 20.4 mL of 2-chloroethyl vinyl ether was added slowly while keeping the temperature at 60° C. The reaction mixture was heated at this temperature for 2 hours, and the progress of the reaction was followed by GC. After cooling, the reaction product was added dropwise to 500 mL of water. The precipitated product was then filtered and redissolved in 500 mL of diethyl ether. The ether layer was washed one time with 100 mL of 3% aqueous NaOH and two times with 100 mL portions of distilled water. The ether layer was dried with sodium sulfate, filtered and evaporated. A 55% yield of 2-(4-hydroxymethyl-phenoxy)ethyl vinyl ether was obtained.

Addition of a Protective Group Preparation of 2-(4-Trimethylsilyloxymethyl-Phenyl)Ethyl Vinyl Ether via Reaction with Chlorotrimethylsilane In a three-neck round-bottom flask equipped with a stirring bar, addition funnel, thermometer, and nitrogen inlet were placed 33 mL of toluene, 5.0 g of 4-(hydroxymethyl-phenoxy)ethyl vinyl ether (prepared as above) and 2.73 g of triethylamine. To this, a solution of 2.94 g of chlorotrimethyl silane in 33 mL of toluene was added over a period of 15 minutes while keeping the temperature below 35° C. The mixture was then heated to 60° C. for one hour. After cooling, the the organic salt which precipitated was filtered off, and the toluene was evaporated. An 87% yield of 2-(4-trimethylsilyloxymethyl-phenoxy)ethyl vinyl ether was obtained.

EXAMPLE 2

Preparation of Phenyl Vinyl Ether/Maleic Anhydride Copolymer (a) +(c)

Phenyl vinyl ether (88.1 g, 0.7341 moles) (prepared as in Example 1) and maleic anhydride (71.9 g, 0.7341 moles) were dissolved in 1224 mL of 1,2-dichloroethane. The solution was placed in a 2-liter three-neck round-bottom flask equipped with a thermometer, a condenser, and nitrogen inlet, and it was purged with nitrogen for half an hour. Then VAZO® (4.7 g, 0.02447 moles) (a radical intiator supplied by DuPont) and butanethiol (11.8 mL, 0.1101 moles) were added under nitrogen. The polymerization was carried out at 60° C. for about 24 hours to complete monomer conversion. The polymer was isolated by precipitation in hexane.

EXAMPLE 3

Preparation of 2-(4-Trimethylsilyloxymethyl-Phenoxy)Ethyl Vinyl Ether/Maleic Anhydride Copolymer In a 50-mL three-neck round-bottom flask equipped with a thermometer, a condenser and a nitrogen inlet, was placed a solution of 4 g of 2-(4-trimethylsilyloxymethyl-phenoxy)ethyl vinyl ether (prepared as in Example 1) and 1.47 g of maleic anhydride in 25.1 mL of 1,2-dichloroethane. The system was purged with nitrogen for 30 minutes. Then 96 mg VAZO®67, and 0.24 mL butanethiol were added under nitrogen. The polymerization was carried out at 60.C for twenty-four hours or longer until complete monomer conversion. The copolymer was isolated by precipitation in hexane.

Hydrolysis of 4-(Trimethylsilyloxymethyl-Phenoxy)Ethyl Vinyl Ether/Maleic Anhydride Copolymer (b) +(c)

A slurry was made with 20 g of 2-(4-silyloxymethyl-phenoxy)ethyl vinyl ether/maleic anhydride copolymer in 498 g of distilled water. To this was added 108 g of a 20% aqueous NaOH solution. The slurry was heated to 75° C. for 48 hours. The reaction mixture was cooled to room temperature to give a 3.37% solution of 2-(4-hydroxymethyl-phenoxy)ethyl vinyl ether/maleic diacid at pH 12.7.

EXAMPLE 4

Phenyl Vinyl Ether/2-(4-Trimethylsisyloxymethyl-Phenoxy)Ethyl Vinyl Ether/Maleic Anhydride Terpolymer In a three-neck round-bottom flask was placed a solution of phenyl vinyl ether (5.26 g (prepared as in Example 1), 2-(4-trimethylsilyloxymethyl-phenoxy) ethyl vinyl ether (5.0 g) (prepared as in Example 1) and maleic anhydride (6.13 g) in 104 mL of 1,2-dichloroethane. The system was purged with nitrogen for 20 min. Then 0.40 g of VAZO®67 and 1.0 mL of butanethiol were added, followed by another twenty minutes purging with nitrogen. The reaction mixture was then heated at 60° C. for seventeen hours. The reaction mixture was then cooled at room temperature and air was allowed into the system. The terpolymer was isolated by precipitation in hexane. The solid was analyzed by IR and NMR.

Hydrolysis of Phenyl Vinyl Ether/2-(4-Trimethylsilyloxymethyl-Phenoxy)Ethyl Vinyl Ether/Maleic Anhydride Terpolymer (a) +(b) +(c)

A slurry was made with 10.2 g of phenyl vinyl ether/2-(4-trimethylsilyloxymethyl-phenoxy)ethyl vinyl ether/maleic anhydride terpolymer in 181.5 g distilled water. Then 12.3 g of a 20% aqueous NaOH solution was added and the slurry was heated to 75° C. for 48 hours. The reaction mixture was cooled to room temperature to give a 4.66% solution of phenyl vinyl ether/2-(4-hydroxymethyl-phenoxy)ethyl vinyl ether/-maleic diacid at pH 8.2.

EXAMPLE 5

Terpolymerization of Perfluoroalkyl Ethyl Vinyl Ether with Maleic Anhydride and an Alkyl Vinyl Ether (Comparative)

Another coating was prepared by reacting 0.57 g (0.005831 mol) of maleic anhydride with 2.0 g (0.004082 mol) of 1H, 1H, 2H, 2H-perfluorodecyl vinyl ether and 0.517 g (0.001749 mol) of octadecyl vinyl ether. The reactants were combined in a 100 mL three-neck round-bottom flask. The octadecyl vinyl ether, 19.4 mL of 1,2-dichloroethane, and 44.8 mg of VAZO®67 were placed in the flask and heated to 60° C., at which time the perfluorodecyl vinyl ether was added. After 80 minutes heating ceased and air was admitted to stop polymerization. 20 mL THF was added and the polymer precipitated in cold water. About 900 mg of the recovered polymer was dissolved in THF and then hydrolyzed by adding 1.5 mL $H_2O$ and 0.3 mL of 96% $H_2SO_4$ and refluxing for 6 hours. After precipitating in water about 620 mg of polymer was recovered.

EXAMPLE 6

Pieces of Nylon-6 carpet (12.7 cm ×12.7 cm) were soaked for 3 minutes in a 0.66 wt.% aqueous solution (pH 4) of a phenyl vinyl ether/maleic diacid copolymer (a) prepared generally by the procedures of Example 1. The temperature of the solution was maintained at 75° C. After soaking, the carpet samples were centrifuged to remove excess solution and leaving about 0.75 wt.% of the copolymer on the fibers. The samples were then dried in an oven at 120° C. and then evaluated for hand and bulk according to the procedure described below. The samples were designated Sample A.

EXAMPLE 7

Comparative

Pieces of Nylon-6 carpet were soaked in a 0.66 wt.% aqueous dispersion of a docosyl vinyl ether/maleic diacid copolymer prepared in a manner similar to the copolymer of Example 6. Two equivalents of NaOH for each equivalent of the copolymer were used in preparing the dispersion and thereafter the pH was reduced to 5.5 by addition of acetic acid. The samples were treated in the same manner as those of Example 6. They were designated as Sample B.

Example 8

Comparative

A terpolymer of 1H, 1H, 2H, 2H-tetrahydro perfluorodecyl vinyl ether/octadecyl vinyl ether/maleic diacid (mol ratio 0.4/0.1/0.5) was prepared in a manner generally similar to that of Example 5. The terpolymer was dissolved in water using 1.73 equivalents of NaOH at 80° C. to make a 0.66 wt.% solution. The pH was reduced to 5 using acetic acid. The solution was then used to soak carpet samples as described in Example 6 and designated as Sample C.

EXAMPLE 9

Comparative

A copolymer of 2-phenoxy-ethyl vinyl ether/maleic diacid was prepared in a manner similar to those described in Example 1 and then dissolved in water using 1.7 equivalents of NaOH at 70° C. to prepare a 0.66 wt.% solution. The pH was reduced to 5 with acetic acid. Then the solution was used to treat carpet samples as described in Example 6 and designated as Sample D.

EXAMPLE 10

A terpolymer of the invention as prepared in Example 4 was diluted in water to make a 0.66 wt.% solution. The pH was reduced to 4.2 using sulfamic acid. Samples of carpet were treated as described in Example 6 and designated Invention.

EXAMPLE 11

The samples of treated carpet were evaluated for bulk and hand properties in a subjective evaluation in which the samples were ranked in order of their apparent fiber density. In this rating the fingers are placed on top of the fiber tufts and then pressed gently. Then the finger tips are used to pinch the fibers between them. The samples of Examples 6–10 were evaluated in this manner and ranked as follows.

| Sample | Ranking |
|---|---|
| Invention | 1 (clearly superior) |
| A | 2 (slightly |
| B | 2 better |
| D | 2 than control) |
| Control (Untreated) | 3 |
| C | 4 (worse) |

We claim:

1. A process for the enhancement of bulk and hand of carpeting comprising applying to said carpeting an amount effective to enhance the bulk and hand of a terpolymer which is the reaction product of (a) phenyl vinyl ether, (b) 2-(4-hydroxymethyl-phenoxy)ethyl/vinyl ether, (c) maleic anhydride in proportions effective to enhance the bulk and hand of said carpeting.

2. The process of claim 1 wherein the terpolymer is a phenyl vinyl ether/2-(4-hydroxymethyl-phenoxy)ethyl vinyl ether/maleic diacid terpolymer.

3. The process of claim 2 wherein said terpolymer is made by reacting (a), (b) containing a protective group, and (c) in a solvent with a radical initiator at a temperature of about 40–100° C. and thereafter hydrolyzing the reaction product.

4. The process of claim 3 wherein said protective group is $—OSi(CH_3)_3$.

5. The process of claim 2 wherein said terpolymer is applied to said carpeting as an aqueous terpolymer is applied to said carpeting as an aqueous solution, emulsion, or foam and thereafter drying.

6. The process of claim 2 wherein said terpolymer is 35 to 40 mol.% (a), 15 to 10 mol.% (b), and about 50 mol.% (c).

7. A process for the enhancement of bulk and hand of carpeting comprising applying to said carpeting an amount effective to enhance the bulk and hand of a mixture of copolymers in proportions effective to enhance the bulk and hand of said carpeting said copolymers being (i) a copolymer of phenyl vinyl ether and maleic anhydride and (ii) a copolymer of 2-(4-hydroxymethyl-phenoxy)ethyl vinyl ether and maleic anhydride.

8. The process of claim 7 wherein said mixture is 30 to 20 wt.% of copolymer (ii) and 70 to 80 wt.% of copolymer (i).

* * * * *